US007669857B2

(12) United States Patent
Sandoval et al.

(10) Patent No.: US 7,669,857 B2
(45) **Date of Patent: *Mar. 2, 2010**

(54) ELECTRONIC LAST-TO-ANSWER TIMED RESPONSE GAME

(75) Inventors: Julio Sandoval, Wilmington, CA (US); George T. Foster, Placerville, CA (US); Tom Grimm, Napa, CA (US)

(73) Assignee: Rudell Design, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/582,060

(22) Filed: Oct. 16, 2006

(65) Prior Publication Data

US 2007/0284827 A1 Dec. 13, 2007

Related U.S. Application Data

(63) Continuation-in-part of application No. 11/452,470, filed on Jun. 13, 2006.

(51) Int. Cl.
*A63F 9/18* (2006.01)

(52) U.S. Cl. ..... 273/429; 273/432

(58) Field of Classification Search ..... 473/429–432; 434/322

See application file for complete search history.

(56) References Cited

U.S. PATENT DOCUMENTS 3,763,577 A * 10/1973 Goodson ..... 434/352
3,852,894 A * 12/1974 Ryland ..... 434/352
3,865,367 A * 2/1975 Breslow et al. ..... 273/432
4,300,763 A * 11/1981 Barr ..... 273/460
4,372,554 A * 2/1983 Orenstein ..... 273/430
4,444,391 A * 4/1984 Kaga et al. ..... 273/445
4,767,335 A * 8/1988 Curt ..... 434/352
4,772,027 A * 9/1988 Martel et al. ..... 273/237
4,799,678 A * 1/1989 Terzian et al. ..... 463/32
4,895,364 A * 1/1990 Martel et al. ..... 273/237
5,092,779 A * 3/1992 Piwonka et al. ..... 434/352
5,219,433 A * 6/1993 Zaruba et al. ..... 273/432
5,364,108 A * 11/1994 Esnouf ..... 463/9
6,019,372 A * 2/2000 Polaski et al. ..... 273/272
6,171,188 B1 * 1/2001 Elstner ..... 463/40
6,279,909 B1 * 8/2001 Alexander et al. ..... 273/249
6,419,232 B1 * 7/2002 Sturdevant, II ..... 273/430
6,547,245 B1 * 4/2003 Olutunfese ..... 273/248
6,641,402 B2 * 11/2003 Boggs ..... 434/236
6,761,358 B2 * 7/2004 Hallett ..... 273/430
2005/0170873 A1 * 8/2005 Fishbach et al. ..... 463/9

OTHER PUBLICATIONS

Last Word, comments on play of game found at website http://www.funagain.com/control/product/-product_id=015400, 2007.*

* cited by examiner

*Primary Examiner*—William M Pierce
(74) *Attorney, Agent, or Firm*—Ben J. Yorks; Irell & Manella LLP

(57) ABSTRACT

An electronic game that awards the last player to correctly answer a question before the expiration of a timer. The game includes a plurality of buttons and corresponding indicators coupled to a housing. A question is provided to the players. A timer counts to a time interval. The controller activates an indicator associated with a button that was depressed last by a player that provides a correct answer to the question at the expiration of the timer. The last player can then move a token on a board. The player that moves their token to the end of the board wins the game.

12 Claims, 6 Drawing Sheets

ELECTRONIC LAST-TO-ANSWER TIMED RESPONSE GAME

CROSS-REFERENCE TO RELATED APPLICATION

This application is a continuation-in-part of U.S. application Ser. No. 11/452,470, filed on Jun. 13, 2006.

BACKGROUND OF THE INVENTION

1. Field of the Invention

The present invention relates to an electronic game.

2. Prior Art

There have been marketed various electronic games that include questions and answers. For example, there has been marketed under the trademark IN YOUR FACE that displays questions and squirts a player with water if they do not answer the question correctly. Questions for players to answer are displayed on an LCD screen. This product is covered by U.S. Pat. Nos. 5,222,660 and 5,992,853.

Hasbro Games markets a game under the name CATCH PHRASE wherein a player would have to provide phrases before an electronic timer elapsed. Hasbro also markets a game under the name TABOO that included an electronic horn that sounded off when a player provided an inaccurate answer to a question.

Buffalo Games, Inc. of Buffalo, N.Y., has markets a game call LAST WORD. LAST WORD includes a deck of cards that each have a subject such as "vegetable" or "breed of dog". The players have to provide relevant responses such as carrot for vegetable, or terrier for breed of dog. The person who provides the last correct response before the expiration of a timer gets to move a token on a board. The player who moves their token to the end of the board wins the game.

BRIEF SUMMARY OF THE INVENTION

An electronic game that includes a plurality of buttons and corresponding indicators coupled to a housing. The game includes a question generator that generates a question and a timer that counts to a time interval. The housing includes a controller that activates an indicator associated with a button that was depressed last by a player that provides a correct answer to the question before the expiration of the timer.

DETAILED DESCRIPTION

Disclosed is an electronic game that awards the last player to correctly answer a question before the expiration of a timer. The game includes a plurality of buttons and corresponding indicators coupled to a housing. A question is provided to the players. A timer counts to a time interval. The controller activates an indicator associated with a button that was depressed last by a player that provides a correct answer to the question at the expiration of the timer. The last player can then move a token on a board. The player that moves their token to the end of the board wins the game.

Figure 1:
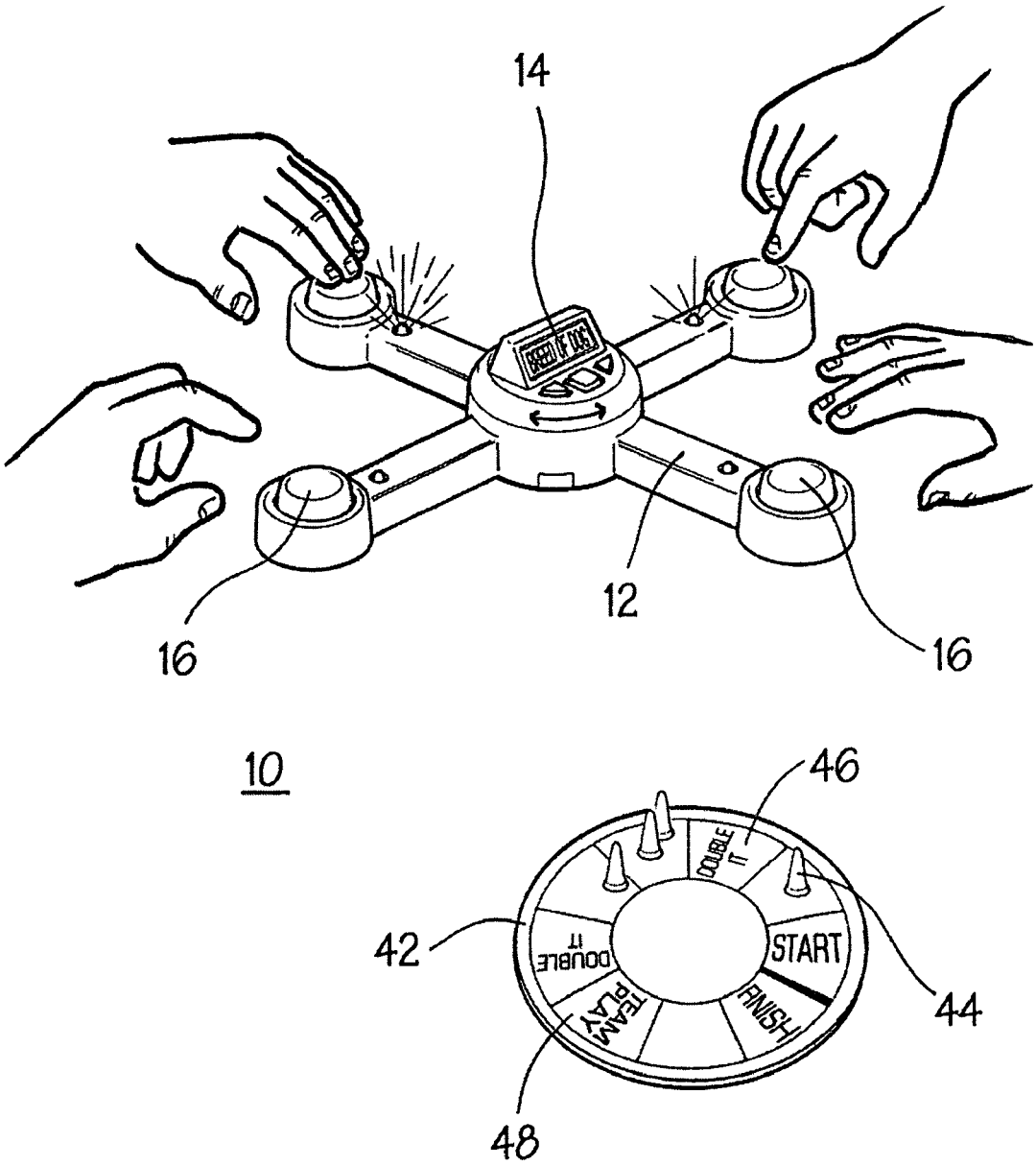
FIG. 1 is an illustration of an electronic game.
Figure 2:
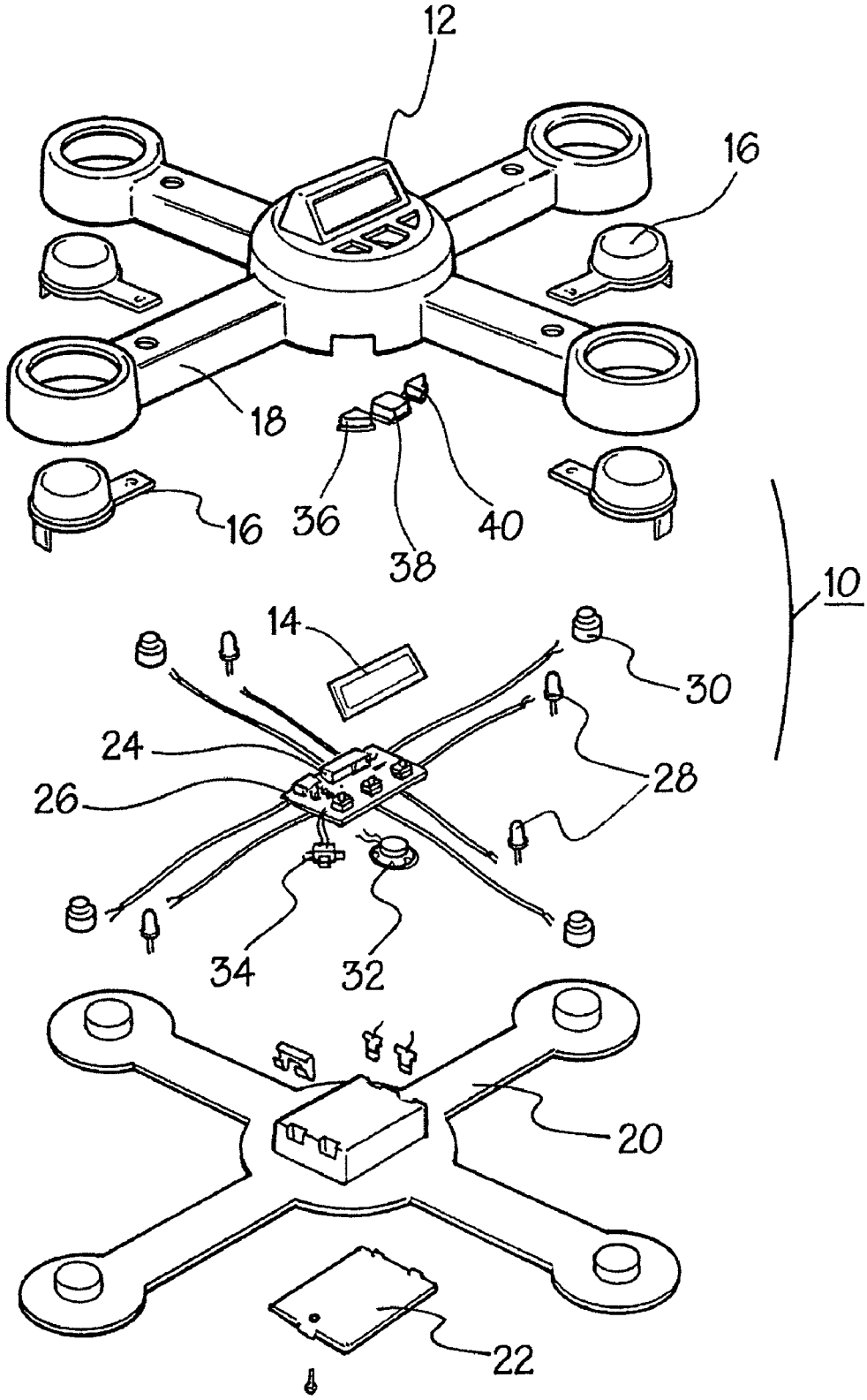
FIG. 2 is an illustration of an exploded view of the electronic game.

Referring to the drawings more particularly by reference numbers, FIGS. 1 and 2 show an embodiment of an electronic game 10. The game 10 includes a housing 12 that supports a screen 14 and a plurality of buttons 16. The screen 14 may be pivotally connected to the housing 12 as indicated by the arrows. The housing 12 may include a top component 18, a bottom component 20 and a battery lid 22 that are constructed from a lightweight and inexpensive plastic material such a polystyrene or equivalent. The buttons 16 may also be constructed from a similar plastic material.

The housing 12 may enclose a controller 24 located on a printed circuit board assembly 26. The controller 24 is coupled to the screen 14 and a plurality of indicators 28. There may be an indicator 28 associated with each button 16. The indicators 28 may be light sources that can be illuminated by the controller 24.

Each button 16 may include a switch 30 that is connected to the controller 24. The game 10 may further have a speaker 32, an ON/OFF switch 34 and an array of PLAY buttons 36, 38 and 40.

The game 10 may include a board 42 and various tokens 44. Although a board 42 is shown and described, it is to be understood that there may be other ways to score or otherwise reward a player of the game, such as by means of a scorepad and writing instrument, wherein numerical scores can be listed for winners of particular game play sessions.

The controller 24 operates in accordance with instructions and data to facilitate play of the game. The instructions and data may be stored in memory. The controller 24 may include an internal timer that counts to a time interval.

To play a game, button 38 may be depressed to display a question on the screen 14. Buttons 36 and 40 may be used to scroll through different questions. The screen 14 may face one of the players who reads the question or subject. The screen 14 can be rotated to a different player after each round of play. The display of the question also begins a timer. The timer function may be performed by the controller 24. Preferably, the time interval of the timer can vary for each round of play, so that players cannot learn, by past gameplay experience, when a round of play is about to end.

A player can then push a button 16 to answer the question. An indicator 28 can be illuminated for the round to begin, at which time a first person may push their button. The person that pushed their button may be given a time limit to answer the question. For example, the indicator can flash for two seconds. The person with the illuminated indicator is allowed to answer the question. The players continue to push their buttons and provide answers to the question. A player can press their button and call out an answer and then push their button again to call out another answer, without giving time to any other player to push their own button and call out an answer. A player cannot provide the same answer as a previous player, nor can a player provide a same answer twice. This play continues until the time interval of the timer expires. The game may emit a sound through the speaker 32 that indicates the count down of the timer. The sound may vary as the timer approaches the time out value. For example, the speaker may generate a beep, beep, beep sound that increases in frequency as the timer counts the time interval.

The last player to push their button and provide a correct answer to the question "wins" the round. The controller illuminates the indicator of the person who last pushed their button before the timer expired, and can also illuminate the button of the next to last player to have pressed their button and called out an answer. By way of example, the indicator may rapidly turn on and off. If the last player to push the button did not provide a correct answer then the next to last person to push the button and provide a correct answer may be awarded the round. By way of example, the indicator of the next to last person may have a slow blinking light to differentiat it from the very last person to have pressed their button.

The person who wins the round can move their token 44 one space on the board 42. The steps of displaying a question, being the last person to correctly answer the question and moving a token can be repeated until one of the players moves their token to the end of the board. The board may include a DOUBLE-IT space 46. If a player moves their token onto a DOUBLE-IT space then on the next round of play, any player who was the last to have answered before the timer ran out can, if they like, attempt to provide a second correct answer to the question, after the completion of the round. A correct answer would allow that player to move two squares on the board, one for the correct answer to win the round, and one for having given a second correct answer. An incorrect second answer would result in that player only moving their token the typical one gameboard space. The board may also have a TEAM PLAY square 48. If a player moves their token into a TEAM PLAY square then that player and another player (perhaps the one to their left or to their right) can both move one gameboard space if either of them win the round.

Figure 3:
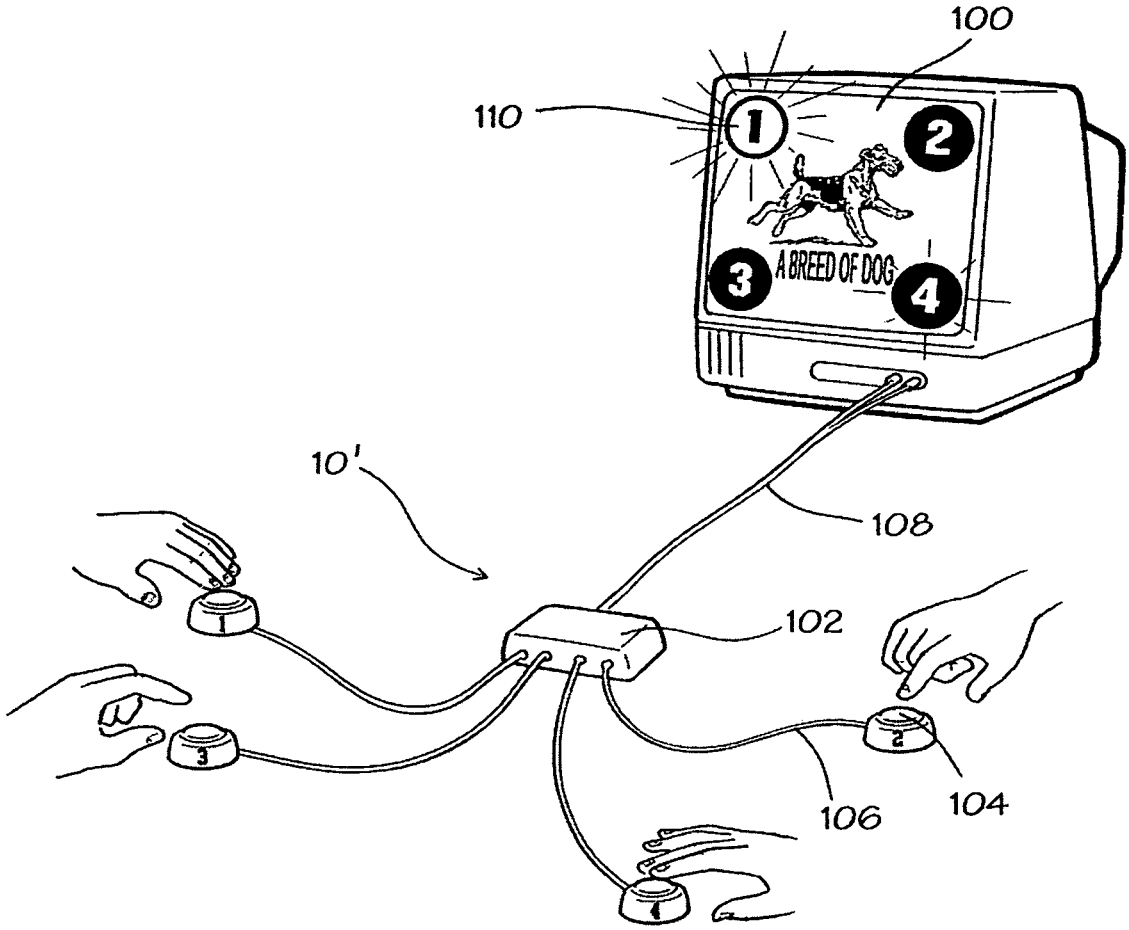
FIG. 3 is an illustration of an alternate embodiment of the electronic game.

FIG. 3 shows an alternate embodiment of a game 10' that can be connected to a television screen 100. The game includes a housing 102 that contains the controller etc. shown and described in the embodiment of FIGS. 1 and 2. The housing 102 is connected to a plurality of buttons 104 by wires 106. The housing 102 is connected to the television 100 by wires 108. The controller within the housing causes a question to be displayed by the television 100. The controller can also cause the display of graphical indicators 110 that are associated with each player.

The game play is similar to that described for the embodiment shown in FIGS. 1 and 2. The graphical indicators 110 may be illuminated for each player that pushes a button, and for the last player and next to last player of a round. The game 10' may also include a board and token (not shown).

Figure 4:
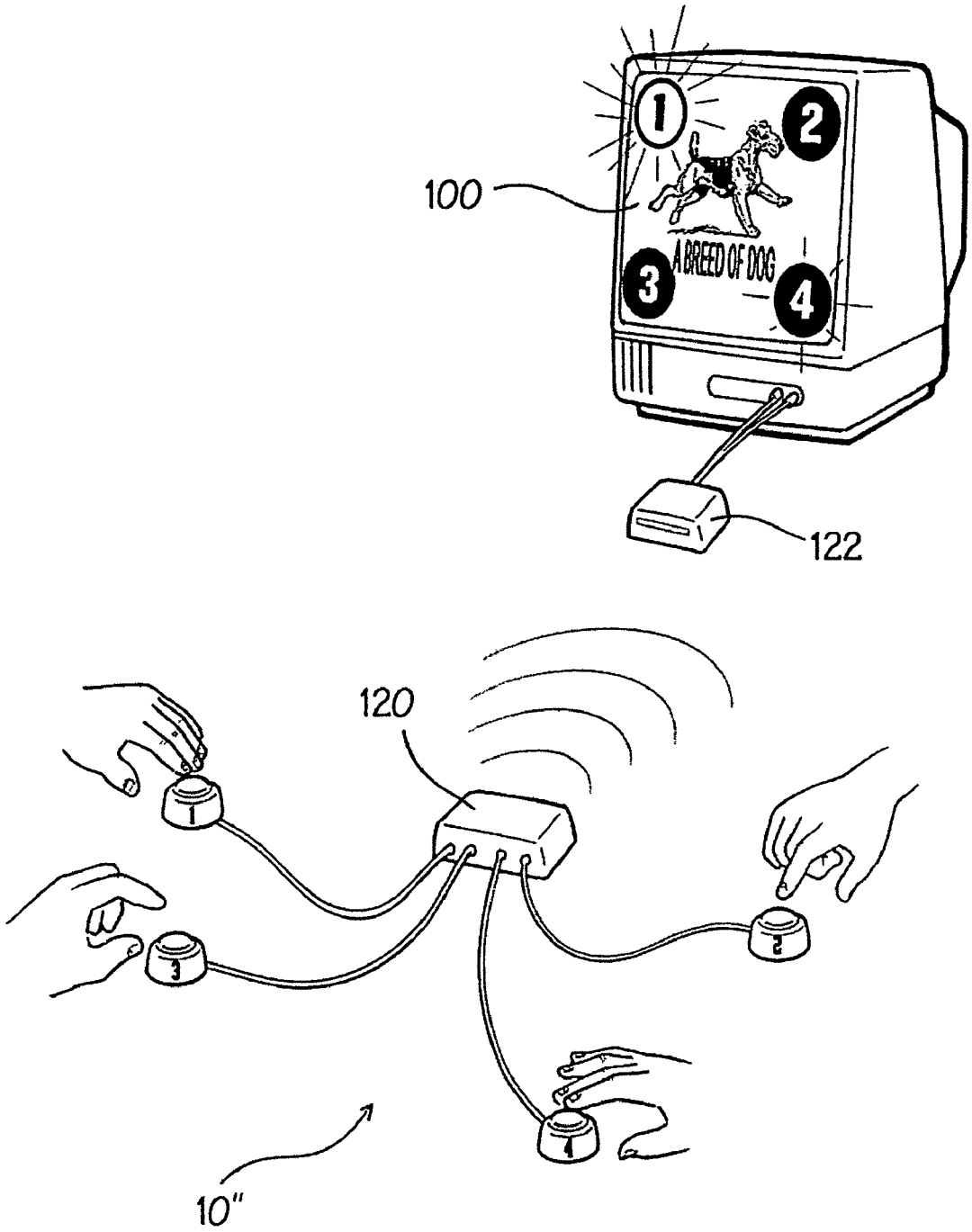
FIG. 4 is an illustration of an alternate embodiment of the electronic game.

FIG. 4 shows yet another embodiment of a game 10" wherein a housing 120 is coupled to the television 100 by a wireless receiver 122, and signals are sent via radio frequency or infrared signaling.

Figure 5:
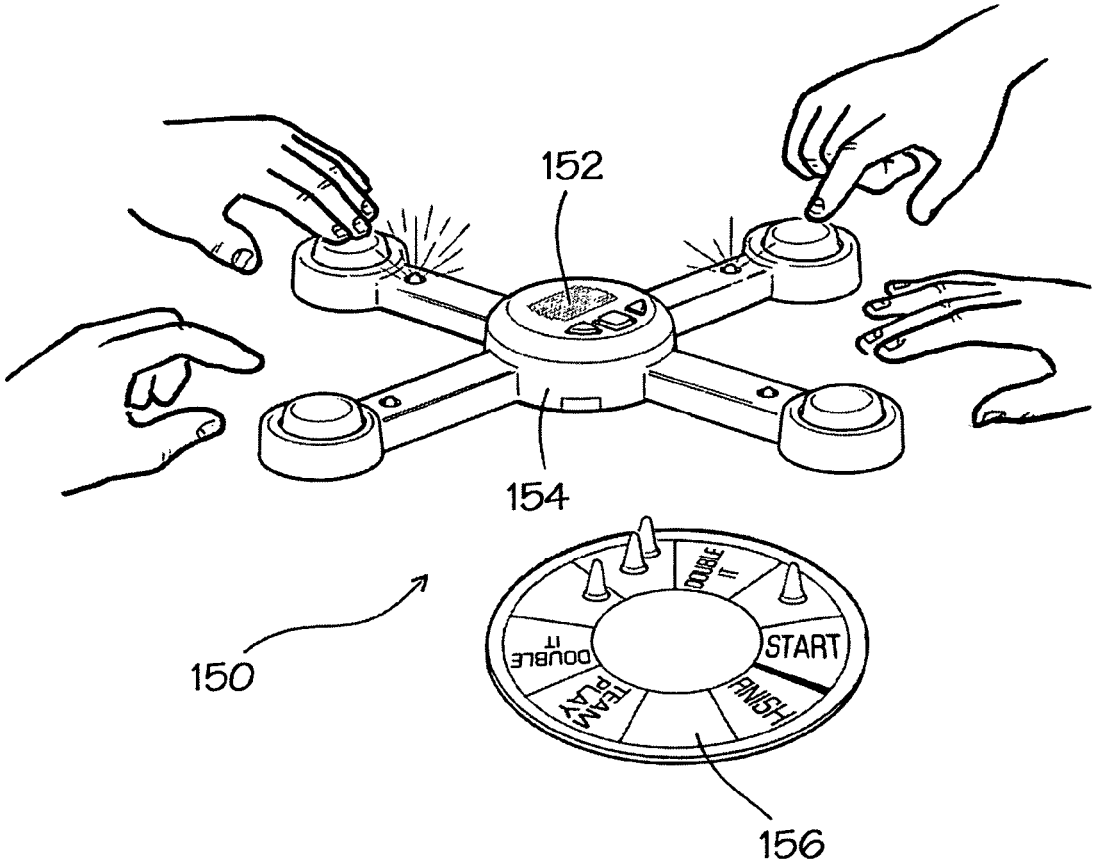
FIG. 5 is an illustration of an alternate embodiment of the electronic game.

FIG. 5 shows another embodiment of a game 150 which includes a speaker 152 mounted to a housing 154. The housing 154 includes the controller, buttons, etc. shown and described in the game 10 of FIGS. 1 and 2. The controller (not shown) may generate speech that is emitted by the speaker 152. The speech may form the questions provided to the players. The game play may be the same as described relative to the game 10 in FIGS. 1 and 2 and described in the accompanying text, except the questions are audibly generated instead of visually presented by a screen. The game 150 may also include a board 156.

Figure 6:
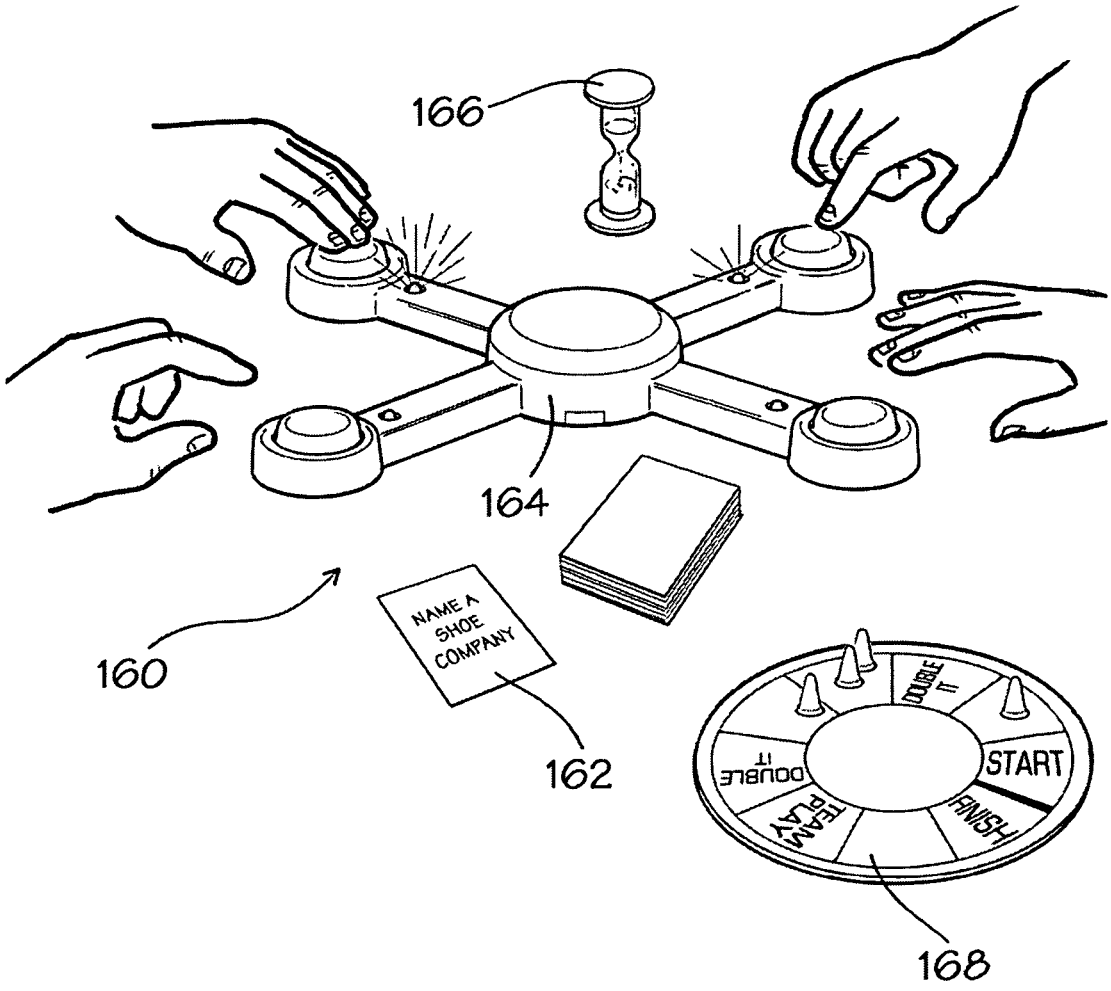
FIG. 6 is an illustration of an alternate embodiment of an electronic game.

FIG. 6 shows another embodiment of a game 160 which contains a plurality of cards 162 that provide the questions for game play. Although cards 162 are shown and described, it is to be understood that other forms of printed matter may be used to provide the questions. The game includes a housing 164 that contains the controller, buttons, indicators, etc. The game play may be the same as described relative to the game shown in FIGS. 1 and 2, and described in the accompanying text, except the questions are provided by the cards 162. The game 160 may include an hour glass timer 166, in lieu of an electronic timer. The last player to correctly answer a question when the hour glass is depleted wins the round. The game 160 may also include a board 168.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An electronic game, comprising:

a housing;

a plurality of buttons coupled to said housing;

a plurality of indicators coupled to said housing and associated with said buttons;

a question;

a timer that counts a time interval; and, a controller that is coupled to said buttons and programmed with instructions such that it activates said indicator associated with said button that was depressed last by a player that provides a correct answer to the question before an expiration of the time interval, at least two buttons are depressed during said time interval.

2. The game of claim 1, wherein said question is generated by a speaker.

3. The game of claim 1, wherein said question is provided by a card.

4. The game of claim 1, wherein said timer is electronic.

5. The game of claim 1, wherein said timer is an hour glass.

6. The game of claim 1, further comprising a game board and a plurality of tokens for each player of the game, one of said tokens being advanced each time said indicator is activated.

7. An electronic game, comprising:

a housing;

a plurality of buttons coupled to said housing;

a plurality of indicators coupled to said housing and associated with said buttons;

question means for presenting a question;

timer means for counting a time interval; and, a controller that is coupled to said buttons and programmed with instructions such that it activates said indicator associated with said button that was depressed last by a player that provides a correct answer to the question before expiration of the time interval, at least two buttons are depressed during said time interval.

8. The game of claim 7, wherein said question means includes a speaker that audibly generates questions.

9. The game of claim 7, wherein said question means includes a plurality of cards.

10. The game of claim 7, wherein said timer means is electronic.

11. The game of claim 7, wherein said timer means is an hour glass.

12. The game of claim 7, further comprising a game board and a plurality of tokens for each player of the game, one of said tokens being advanced each time said indicator is activated.

* * * * *